US010408207B2

(12) United States Patent
Yamada et al.

(10) Patent No.: US 10,408,207 B2
(45) Date of Patent: Sep. 10, 2019

(54) BELLOWS PUMP DEVICE

(71) Applicant: NIPPON PILLAR PACKING CO., LTD., Osaka (JP)

(72) Inventors: Masateru Yamada, Osaka (JP); Kazukiyo Teshima, Osaka (JP); Atsushi Nakano, Osaka (JP); Daisuke Urata, Osaka (JP); Keiji Nagae, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 196 days.

(21) Appl. No.: 15/500,716

(22) PCT Filed: Jul. 6, 2015

(86) PCT No.: PCT/JP2015/069375
§ 371 (c)(1),
(2) Date: Jan. 31, 2017

(87) PCT Pub. No.: WO2016/021351
PCT Pub. Date: Feb. 11, 2016

(65) Prior Publication Data

US 2017/0218946 A1 Aug. 3, 2017

(30) Foreign Application Priority Data

Aug. 4, 2014 (JP) ..... 2014-158570

(51) Int. Cl.
*F04B 49/06* (2006.01)
*F04B 43/08* (2006.01)
(Continued)

(52) U.S. Cl.
CPC ..... *F04B 49/06* (2013.01); *F04B 11/0058* (2013.01); *F04B 43/026* (2013.01);
(Continued)

(58) Field of Classification Search
CPC .. F04B 49/06; F04B 45/0733; F04B 11/0058; F04B 53/16; F04B 53/10; F04B 49/065;
(Continued)

(56) References Cited

U.S. PATENT DOCUMENTS 4,543,044 A * 9/1985 Simmons ..... F04B 9/1176 417/342
5,088,898 A 2/1992 Fukumoto et al.
(Continued)

FOREIGN PATENT DOCUMENTS

CN 202300954 A 7/2012
CN 103388577 A 11/2013
(Continued)

OTHER PUBLICATIONS

Machine Translation of WIPO document WO 2010143469 A1 to Yoshida published Dec. 16, 2010.*
(Continued)

*Primary Examiner* — Peter J Bertheaud
*Assistant Examiner* — Dnyanesh G Kasture
(74) *Attorney, Agent, or Firm* — Millen, White, Zelano & Branigan, P.C.; William Nixon

(57) ABSTRACT

A bellows pump device includes first and second bellows mounted on a pump head so as to be expandable/contractible independently of each other and configured to suck a fluid from a suction passage thereinto by expansion thereof and discharge the fluid therefrom to a discharge passage by contraction thereof. First and second air cylinder portions are configured to respectively cause the first and second bellows to perform expansion/contraction operation. First and second detection devices are configured to detect expanded/contracted states of the first and second bellows, respectively. A control unit is configured to control drive of the first and second air cylinder portions on the basis of each
(Continued)

of detection signals of the first and second detection devices such that, before one bellows comes into a most contracted state, the other bellows is caused to contract from a most expanded state.

3 Claims, 9 Drawing Sheets

(51) Int. Cl.

| | |
|---|---|
| ***F04B 43/10*** | (2006.01) |
| ***F04B 43/02*** | (2006.01) |
| ***F04B 45/02*** | (2006.01) |
| ***F04B 53/10*** | (2006.01) |
| ***F04B 53/16*** | (2006.01) |
| ***F04B 11/00*** | (2006.01) |
| ***F04B 43/113*** | (2006.01) |
| ***F04B 45/073*** | (2006.01) |

(52) U.S. Cl.
CPC ..... *F04B 43/08* (2013.01); *F04B 43/10* (2013.01); *F04B 43/1136* (2013.01); *F04B 45/022* (2013.01); *F04B 45/0733* (2013.01); *F04B 49/065* (2013.01); *F04B 53/10* (2013.01); *F04B 53/16* (2013.01); *F04B 2201/0201* (2013.01)

(58) Field of Classification Search
CPC .. F04B 43/1136; F04B 43/026; F04B 45/022; F04B 43/08; F04B 43/10; F04B 2201/0201
See application file for complete search history.

(56) References Cited

U.S. PATENT DOCUMENTS

| | | | |
|---|---|---|---|
| 5,224,841 | A | 7/1993 | Thompson |
| 6,364,640 | B1 | 4/2002 | Nishio et al. |
| 9,239,047 | B2 | 1/2016 | Iwabuchi et al. |
| 2001/0018930 | A1 | 9/2001 | Katsura |
| 2014/0010689 | A1 | 1/2014 | Iwabuchi et al. |

FOREIGN PATENT DOCUMENTS

| | | | |
|---|---|---|---|
| EP | 0431753 | A1 | 6/1991 |
| JP | H08 121342 | A | 5/1996 |
| JP | H08-159016 | A | 6/1996 |
| JP | 2000-002187 | A | 1/2000 |
| JP | 2001-123959 | A | 5/2001 |
| JP | 2001-248741 | A | 9/2001 |
| JP | 2004293502 | A | 10/2004 |
| JP | 2008 118026 | A | 5/2008 |
| WO | 2010/143469 | A1 | 12/2010 |

OTHER PUBLICATIONS

International Search Report dated Oct. 6, 2015, issued in corresponding PCT/JP2015/069375, 1 page.
English translation Abstract of WO2010143469A1 published Dec. 16, 2010 (2 pages).
English translation of JP2000-002187 published Jan. 7, 2000 (13 pages).
English translation Abstract of JP2001248741A published Sep. 14, 2001 (2 pages).
English translation of JPH08-159016A published Jun. 18, 1996 (13 pages).
English translation Abstract of JP2001123959A published May 8, 2001 (2 pages).
Supplementary European Search Report relating to EP 15 82 9635 dated Jan. 17, 2018.
English Abstract of JP2004293502, Publication Date: Oct. 21, 2004.
English Machine Translation of JPH08121342, Publication Date: May 14, 1996.
English Machine Translation of JP2008118026, Publication Date: May 22, 2008.
English Translation of Office Action for related Japanese Patent Application No. 2014-158570 dated Jan. 9, 2018.
Office Action for CN201580053804.0 dated May 28, 2018.
English Machine Translation of Office Action for CN201580053804.0 dated May 28, 2018.
English Machine Translation of CN103388577, Publication Date: Nov. 13, 2013.
English Machine Translation of JP2004293502, Publication Date: Oct. 21, 2004.
Office Action for related Japanese Patent Application No. 2014-158570 dated Jan. 9, 2018.

* cited by examiner

FIG. 9

| BELLOWS PUMP | TIE ROD CONNECTION TYPE | ACCUMULATOR -EXTERNALLY -MOUNTED TYPE | ACCUMULATOR -BUILT-IN TYPE | PRESENT INVENTION PRODUCT |
|---|---|---|---|---|
| FLOW RATE [L/min] | 11.6 (26%) | 5.6 (13%) | 13.2 (30%) | 44 (100%) |
| PULSE PRESSURE RANGE [MPa] | 0.164 (205%) | 0.083 (104%) | 0.069 (86%) | 0.080 (100%) |
| FOOTPRINT [$cm^2$] | 989.8 (87%) | 1412.8 (125%) | 942.9 (83%) | 1134 (100%) |

BELLOWS PUMP DEVICE

TECHNICAL FIELD

The present invention relates to a bellows pump device.

BACKGROUND ART

In semiconductor production, chemical industries, or the like, a bellows pump may be used as a pump for feeding a fluid such as a chemical solution, a solvent, or the like.

For example, as disclosed in PATENT LITERATURE 1, in the bellows pump, pump cases are connected to both sides of a pump head in a right-left direction (horizontal direction) to form two air chambers, and a pair of bellows that are expandable/contractible in the right-left direction are provided within the respective air chambers, and the bellows pump is configured such that each bellows is contracted or expanded by alternately supplying pressurized air to the respective air chambers.

In the pump head, a suction passage and a discharge passage for the fluid are formed so as to communicate with the interior of each bellows, and further check valves are provided which permit flow of the fluid in one direction in the suction passage and the discharge passage and blocks flow of the fluid in another direction in the suction passage and the discharge passage. The check valve for the suction passage is configured: to be opened by expansion of the bellows, to permit flow of the fluid from the suction passage into the bellows; and to be closed by contraction of the bellows, to block flow of the fluid from the interior of the bellows to the suction passage. In addition, the check valve for the discharge passage is configured: to be closed by expansion of the bellows, to block flow of the fluid from the discharge passage into the bellows; and to be opened by contraction of the bellows, to permit flow of the fluid from the interior of the bellows to the discharge passage.

The pair of bellows are integrally connected to each other by a tie rod. When one of the bellows contracts to discharge the fluid to the discharge passage, the other bellows forcedly expands at the same time, so that the fluid is sucked from the suction passage. In addition, when the other bellows contracts to discharge the fluid to the discharge passage, the one bellows forcedly expands at the same time, so that the fluid is sucked from the suction passage.

In the bellows pump having the above configuration, a phenomenon (pulsation) that a discharge pressure instantly falls to approximately zero at time of switching between discharge and suction of the fluid, is a problem. In the conventional art, in order to suppress this pulsation, an accumulator (pressure accumulator) is mounted at the discharge side of the bellows pump (see, e.g., PATENT LITERATURE 2), or a bellows pump in which an accumulator is incorporated in place of one of a pair of bellows (see, e.g., PATENT LITERATURE 3) is used.

CITATION LIST

Patent Literature

PATENT LITERATURE 1: Japanese Laid-Open Patent Publication No. 2001-248741

PATENT LITERATURE 2: Japanese Laid-Open Patent Publication No. 8-159016

PATENT LITERATURE 3: Japanese Laid-Open Patent Publication No. 2001-123959

SUMMARY OF INVENTION

Technical Problem

However, in the case of using the accumulator disclosed in PATENT LITERATURE 2, the accumulator separate from the bellows pump has to be installed, so that a large space for installing these devices is required. In addition, in the case of the bellows pump disclosed in PATENT LITERATURE 3 in which the accumulator is incorporated, only the bellows at one side discharges the fluid, so that there is a problem that the amount of the discharged fluid decreases as compared to a bellows pump having a pair of bellows.

The present invention has been made in view of such a situation, and an object of the present invention is to provide a bellows pump device that is able to reduce pulsation at a discharge side without causing a substantial increase in an installation space thereof and a decrease in a discharge amount thereof.

Solution to Problem

A bellows pump device of the present invention is a bellows pump device including: a pump head in which a suction passage and a discharge passage for a fluid are formed; a check valve configured to permit flow of the fluid in one direction in the suction passage and the discharge passage and block flow of the fluid in another direction in the suction passage and the discharge passage; first and second bellows mounted on the pump head so as to be expandable/contractible independently of each other and configured to suck the fluid from the suction passage thereinto by expansion thereof and discharge the fluid therefrom to the discharge passage by contraction thereof; a first driving device configured to cause the first bellows to perform expansion/contraction operation continuously between a most expanded state and a most contracted state; a second driving device configured to cause the second bellows to perform expansion/contraction operation continuously between a most expanded state and a most contracted state; a first detection device configured to detect an expanded/contracted state of the first bellows; a second detection device configured to detect an expanded/contracted state of the second bellows; and a control unit configured to control drive of the first and second driving devices on the basis of each of detection signals of the first and second detection devices such that the second bellows is caused to contract from the most expanded state before the first bellows comes into the most contracted state, and the first bellows is caused to contract from the most expanded state before the second bellows comes into the most contracted state.

According to the bellows pump device configured as describe above, the first bellows and the second bellows are made expandable/contractible independently of each other, and the control unit is configured to perform drive control such that the second bellows is caused to contract from the most expanded state before the first bellows comes into the most contracted state and the first bellows is caused to contract from the most expanded state before the second bellows comes into the most contracted state. Thus, at time of switching from contraction of one bellows (discharge) to expansion thereof (suction), the other bellows has already contracted to discharge the fluid. Accordingly, fall of the discharge pressure at the time of switching can be reduced. As a result, pulsation at the discharge side of the bellows pump device can be reduced.

In addition, it is not necessary to ensure a space for installing another member (accumulator) other than the bellows pump as in the case where an accumulator is mounted at the discharge side of a conventional bellows pump. Thus, a substantial increase in an installation space can be suppressed. Furthermore, since the fluid is discharged by using a pair of the bellows similarly to a conventional bellows pump having a pair of bellows connected to each other by a tie rod, the amount of the discharged fluid does not decrease.

The control unit preferably includes: a first calculation section configured to calculate a first expansion time from the most contracted state of the first bellows to the most expanded state of the first bellows and a first contraction time from the most expanded state of the first bellows to the most contracted state of the first bellows on the basis of the detection signal of the first detection device; a second calculation section configured to calculate a second expansion time from the most contracted state of the second bellows to the most expanded state of the second bellows and a second contraction time from the most expanded state of the second bellows to the most contracted state of the second bellows on the basis of the detection signal of the second detection device; a first determination section configured to determine, on the basis of the calculated first expansion time and the first contraction time, a first time difference from a time point at which the first bellows in the most expanded state starts contraction operation to a time point at which the second bellows in the most expanded state starts contraction operation before the first bellows comes into the most contracted state through the contraction operation; a second determination section configured to determine, on the basis of the calculated second expansion time and second contraction time, a second time difference from a time point at which the second bellows in the most expanded state starts contraction operation to a time point at which the first bellows in the most expanded state starts contraction operation before the second bellows comes into the most contracted state through the contraction operation; and a drive control section configured to control drive of the first and second driving devices such that contraction operation of the second bellows in the most expanded state is started at a time point at which the first time difference elapses from a time point at which the first bellows in the most expanded state starts contraction operation, and contraction operation of the first bellows in the most expanded state is started at a time point at which the second time difference elapses from a time point at which the second bellows in the most expanded state starts contraction operation.

In this case, since the drive control section performs control as described above, the second bellows can be assuredly caused to contract before the first bellows comes into the most contracted state, and also the first bellows can be assuredly caused to contract before the second bellows comes into the most contracted state.

Preferably, the first determination section determines the first time difference on the basis of the first expansion time and first contraction time calculated immediately before, the second determination section determines the second time difference on the basis of the second expansion time and second contraction time calculated immediately before, and the drive control section controls drive of the first and second driving devices on the basis of the first and second time differences determined immediately before.

In this case, since the drive control section performs control as described above, even when the first expansion time and the first contraction time of the first bellows (the second expansion time and the second contraction time of the second bellows) vary, the second bellows (first bellows) can be assuredly caused to contract so as to follow the variation, before the first bellows (second bellows) comes into the most contracted state.

Advantageous Effects of Invention

According to the bellows pump device of the present invention, pulsation at the discharge side can be reduced without causing a substantial increase in an installation space thereof and a decrease in a discharge amount thereof.

BRIEF DESCRIPTION OF DRAWINGS

FIG. 9 is a table showing results of a verification test for bellows pumps.

DESCRIPTION OF EMBODIMENTS

Next, preferred embodiments of the present invention will be described with reference to the accompanying drawings.

[Entire Configuration of Bellows Pump]

Figure 1:
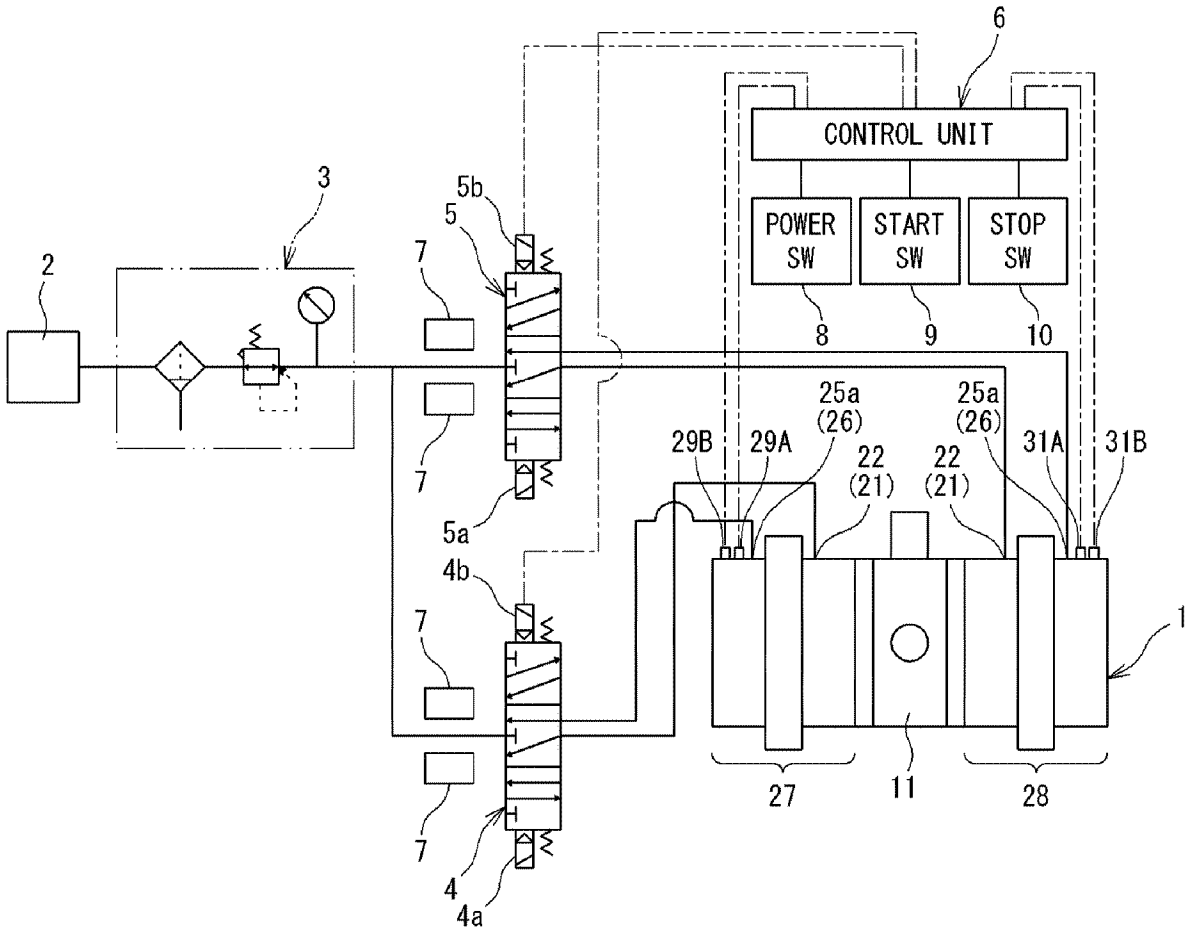
FIG. 1 is a schematic configuration diagram of a bellows pump device according to an embodiment of the present invention.

FIG. 1 is a schematic configuration diagram of a bellows pump device according to an embodiment of the present invention. The bellows pump device of the present embodiment is used, for example, in a semiconductor production apparatus when a transport fluid such as a chemical solution, a solvent, or the like is supplied in a certain amount. The bellows pump device includes: a bellows pump 1; an air supply device 2 such as an air compressor or the like that supplies pressurized air (working fluid) to the bellows pump 1; a regulator 3 that adjusts the pressure of the pressurized air; two first and second switching valves 4 and 5; and a control unit 6 that controls drive of the bellows pump 1.

Figure 2:
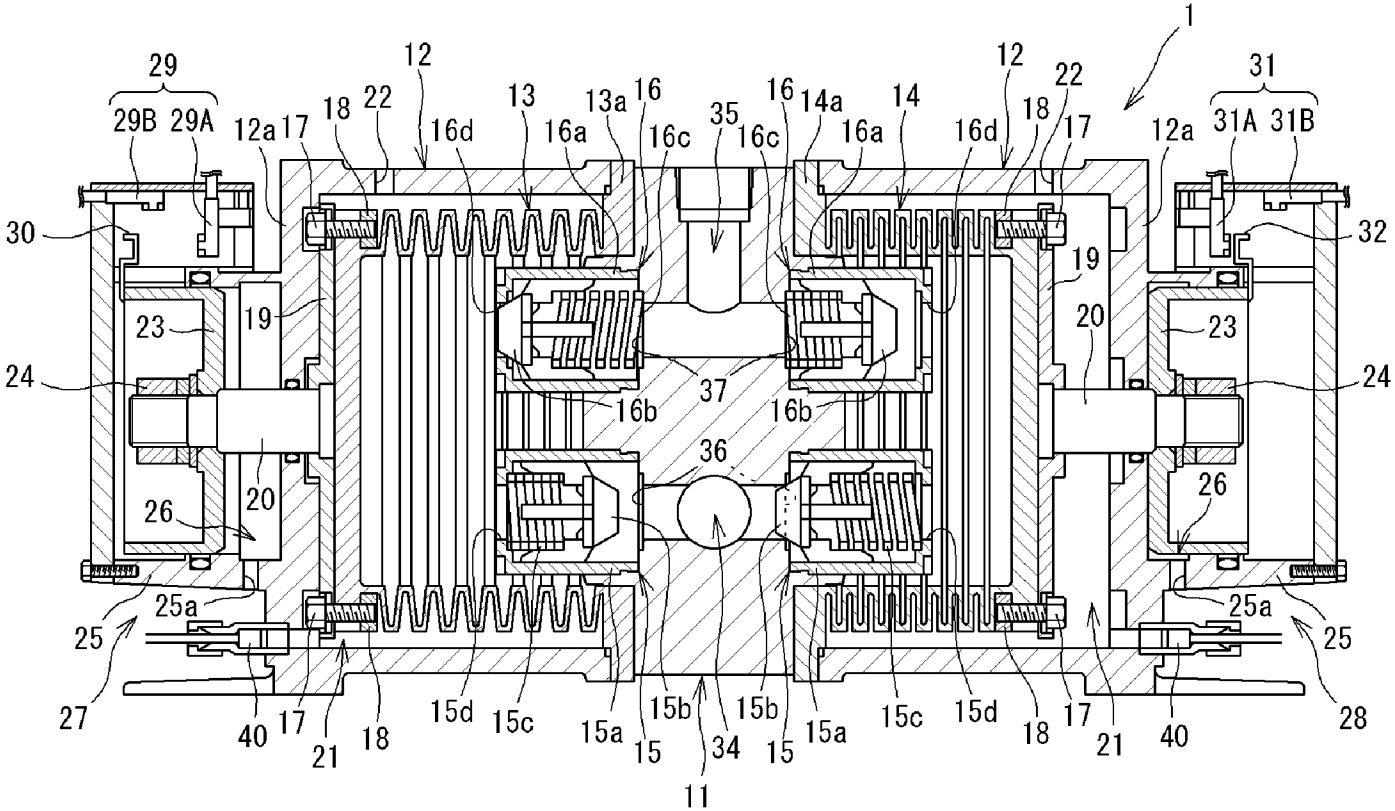
FIG. 2 is a cross-sectional view of a bellows pump.

FIG. 2 is a cross-sectional view of the bellows pump according to the embodiment of the present invention.

The bellows pump 1 of the present embodiment includes: a pump head 11; a pair of pump cases 12 that are mounted at both sides of the pump head 11 in a right-left direction (horizontal direction); two first and second bellows 13 and 14 that are mounted on side surfaces of the pump head 11 in the right-left direction and within the respective pump cases 12; and four check valves 15 and 16 that are mounted on the side surfaces of the pump head 11 in the right-left direction and within the respective bellows 13 and 14.

[Configurations of Bellows]

The first and second bellows 13 and 14 are each formed in a bottomed cylindrical shape from a fluorine resin such as polytetrafluoroethylene (PTFE), a tetrafluoroethylene-perfluoro alkyl vinyl ether copolymer (PFA), or the like, and flange portions 13*a* and 14*a* are integrally formed at open end portions thereof and are hermetically pressed and fixed to the side surfaces of the pump head 11. Peripheral walls of the first and second bellows 13 and 14 are each formed in an accordion shape, and are configured to be expandable/contractible independently of each other in the horizontal direction. Specifically, each of the first and second bellows 13 and 14 is configured to expand/contract between a most expanded state where an outer surface of a working plate 19 described later is in contact with an inner side surface of a bottom wall portion 12*a* of the pump case 12 and a most contracted state where an inner side surface of a piston body 23 described later is in contact with an outer side surface of the bottom wall portion 12*a* of the pump case 12.

The working plate 19, together with one end portion of a connection member 20, is fixed to each of outer surfaces of bottom portions of the first and second bellows 13 and 14 by bolts 17 and nuts 18.

[Configurations of Pump Cases]

Each pump case 12 is formed in a bottomed cylindrical shape, and an opening peripheral portion thereof is hermetically pressed and fixed to the flange portion 13*a* (14*a*) of the corresponding bellows 13 (14). Thus, a discharge-side air chamber 21 is formed within the pump case 12 such that a hermetic state thereof is maintained.

An suction/exhaust port 22 is provided in each pump case 12 and connected to the air supply device 2 via the switching valve 4(5) and the regulator 3 (see FIG. 1). Accordingly, the bellows 13 (14) contracts by supplying the pressurized air from the air supply device 2 via the regulator 3, the switching valve 4(5), and the suction/exhaust port 22 into the discharge-side air chamber 21.

In addition, the connection member 20 is supported by the bottom wall portion 12*a* of each pump case 12 so as to be slidable in the horizontal direction, and the piston body 23 is fixed to another end portion of the connection member 20 by a nut 24. The piston body 23 is supported so as to be slidable in the horizontal direction relative to an inner circumferential surface of a cylindrical cylinder body 25, which is integrally provided on the outer side surface of the bottom wall portion 12*a*, with a hermetic state maintained. Accordingly, a space surrounded by the bottom wall portion 12*a*, the cylinder body 25, and the piston body 23 is formed as a suction-side air chamber 26 of which a hermetic state is maintained.

In each cylinder body 25, a suction/exhaust port 25*a* is formed so as to communicate with the suction-side air chamber 26. The suction/exhaust port 25*a* is connected to the air supply device 2 via the switching valve 4 (5) and the regulator 3 (see FIG. 1). Accordingly, the bellows 13 (14) expands by supplying the pressurized air from the air supply device 2 via the regulator 3, the switching valve 4 (5), and the suction/exhaust port 25*a* into the suction-side air chamber 26.

A leakage sensor 40 for detecting leakage of the transport fluid to the discharge-side air chamber 21 is mounted below the bottom wall portion 12*a* of each pump case 12.

In the bellows pump device of the present embodiment, a time taken until the suction-side air chamber 26 is fully filled with the pressurized air is shorter than a time taken until the discharge-side air chamber 21 is fully filled with the pressurized air. That is, an expansion time (suction time) for which the bellows 13 (14) expands from the most contracted state to the most expanded state is shorter than a contraction time (discharge time) for which the bellows 13 (14) contracts from the most expanded state to the most contracted state.

Because of the above configuration, the pump case 12 in which the discharge-side air chamber 21 at the left side in FIG. 2 is formed, and the piston body 23 and the cylinder body 25 that form the suction-side air chamber 26 at the left side in FIG. 2, form a first air cylinder portion (first driving device) 27 that causes the first bellows 13 to perform expansion/contraction operation continuously between the most expanded state and the most contracted state.

In addition, the pump case 12 in which the discharge-side air chamber 21 at the right side in FIG. 2 is formed, and the piston body 23 and the cylinder body 25 that form the suction-side air chamber 26 at the right side in FIG. 2, form a second air cylinder portion (second driving device) 28 that causes the second bellows 14 to perform expansion/contraction operation continuously between the most expanded state and the most contracted state.

A pair of proximity sensors 29A and 29B are mounted on the cylinder body 25 of the first air cylinder portion 27, and a detection plate 30 to be detected by each of the proximity sensors 29A and 29B is mounted on the piston body 23. The detection plate 30 reciprocates together with the piston body 23, so that the detection plate 30 alternately comes close to the proximity sensors 29A and 29B, whereby the detection plate 30 is detected by the proximity sensors 29A and 29B.

The proximity sensor 29A is a first most contraction detection unit for detecting the most contracted state of the first bellows 13, and is disposed at such a position that the proximity sensor 29A detects the detection plate 30 when the first bellows 13 is in the most contracted state. The proximity sensor 29B is a first most expansion detection unit for detecting the most expanded state of the first bellows 13, and is disposed at such a position that the proximity sensor 29B detects the detection plate 30 when the first bellows 13 is in the most expanded state. Detection signals of the respective proximity sensors 29A and 29B are transmitted to the control unit 6. In the present embodiment, the pair of proximity sensors 29A and 29B form a first detection device 29 for detecting an expanded/contracted state of the first bellows 13.

Similarly, a pair of proximity sensors 31A and 31B are mounted on the cylinder body 25 of the second air cylinder portion 28, and a detection plate 32 to be detected by each of the proximity sensors 31A and 31B is mounted on the piston body 23. The detection plate 32 reciprocates together with the piston body 23, so that the detection plate 32 alternately comes close to the proximity sensors 31A and 31B, whereby the detection plate 32 is detected by the proximity sensors 31A and 31B.

The proximity sensor 31A is a second most contraction detection unit for detecting the most contracted state of the second bellows 14, and is disposed at such a position that the proximity sensor 31A detects the detection plate 32 when the second bellows 14 is in the most contracted state. The proximity sensor 31B is a second most expansion detection unit for detecting the most expanded state of the second bellows 14, and is disposed at such a position that the proximity sensor 31B detects the detection plate 32 when the second bellows 14 is in the most expanded state. Detection signals of the respective proximity sensors 31A and 31B are transmitted to the control unit 6. In the present embodiment, the pair of proximity sensors 31A and 31B form a second detection device 31 for detecting an expanded/contracted state of the second bellows 14.

The pressurized air generated by the air supply device 2 is alternately supplied to the suction-side air chamber 26 and the discharge-side air chamber 21 of the first air cylinder portion 27 by the pair of proximity sensors 29A and 29B of the first detection device 29 alternately detecting the detection plate 30. Accordingly, the first bellows 13 continuously performs expansion/contraction operation.

In addition, the pressurized air is alternately supplied to the suction-side air chamber 26 and the discharge-side air chamber 21 of the second air cylinder portion 28 by the pair of proximity sensors 31A and 31B of the second detection device 31 alternately detecting the detection plate 32. Accordingly, the second bellows 14 continuously performs expansion/contraction operation. At this time, expansion operation of the second bellows 14 is performed mainly during contraction operation of the first bellows 13, and contraction operation of the second bellows 14 is performed mainly during expansion operation of the first bellows 13. By the first bellows 13 and the second bellows 14 alternately repeating expansion/contraction operation as described above, suction and discharge of the fluid to and from the interiors of the respective bellows 13 and 14 are alternately performed, whereby the fluid is transported.

[Configuration of Pump Head]

The pump head 11 is formed from a fluorine resin such as PTFE, PFA, or the like. A suction passage 34 and a discharge passage 35 for the fluid are formed within the pump head 11. The suction passage 34 and the discharge passage 35 are opened in an outer peripheral surface of the pump head 11 and respectively connected to a suction port and a discharge port (both are not shown) provided at the outer peripheral surface. The suction port is connected to a storage tank for the fluid or the like, and the discharge port is connected to a transport destination for the fluid. In addition, the suction passage 34 and the discharge passage 35 each branch toward both right and left side surfaces of the pump head 11, and have suction openings 36 and discharge openings 37 that are opened in both right and left side surfaces of the pump head 11. Each suction opening 36 and each discharge opening 37 communicate with the interior of the bellows 13 or 14 via the check valves 15 and 16, respectively.

[Configurations of Check Valves]

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* that is housed in the valve case 15*a*; and a compression coil spring 15*c* that biases the valve body 15*b* in a valve closing direction. The valve case 15*a* is formed in a bottomed cylindrical shape, and a through hole 15*d* is formed in a bottom wall thereof so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the fluid occurring with expansion/contraction of the bellows 13 or 14 acts thereon.

Accordingly, the suction check valve 15 opens when the bellows 13 or 14 at which the suction check valve 15 is disposed expands, to permit suction of the fluid in a direction (one direction) from the suction passage 34 toward the interior of the bellows 13 or 14, and closes when the bellows 13 or 14 contracts, to block backflow of the fluid in a direction (another direction) from the interior of the bellows 13 or 14 toward the suction passage 34.

The check valve 16 (hereinafter, also referred to as "discharge check valve") mounted at each discharge opening 37 includes: a valve case 16*a*; a valve body 16*b* that is housed in the valve case 16*a*; and a compression coil spring 16*c* that biases the valve body 16*b* in a valve closing direction. The valve case 16*a* is formed in a bottomed cylindrical shape, and a through hole 16*d* is formed in a bottom wall thereof so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the fluid occurring with expansion/contraction of the bellows 13 or 14 acts thereon.

Accordingly, the discharge check valve 16 opens when the bellows 13 or 14 at which the discharge check valve 16 is disposed contracts, to permit outflow of the fluid in a direction (one direction) from the interior of the bellows 13 or 14 toward the discharge passage 35, and closes when the bellows 13 or 14 expands, to block backflow of the fluid in a direction (another direction) from the discharge passage 35 toward the interior of the bellows 13 or 14.

[Operation of Bellows Pump]

Figure 3:
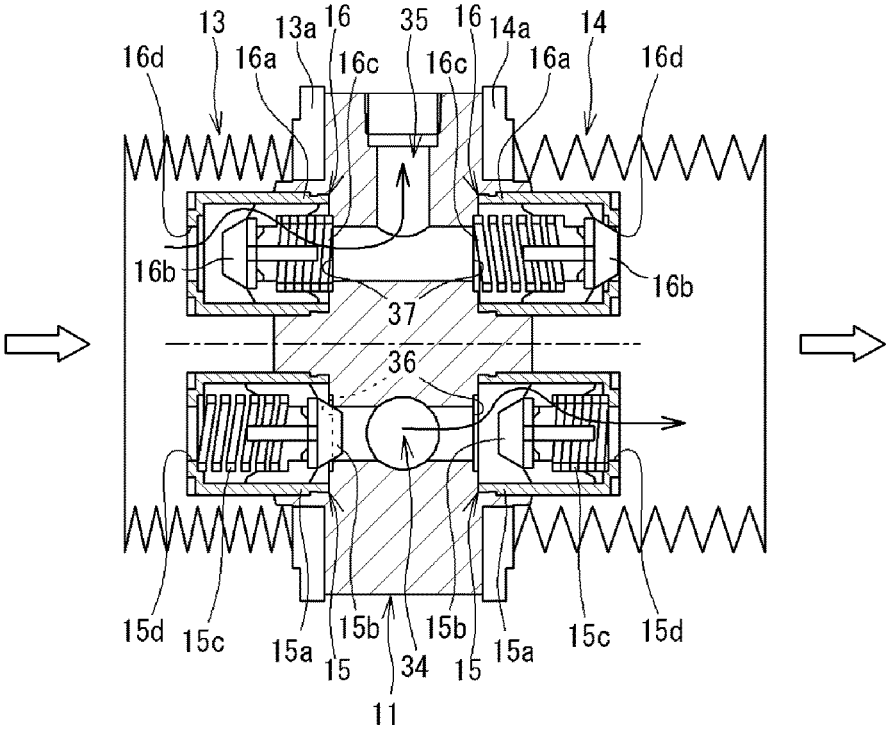
FIG. 3 is an explanatory diagram showing operation of the bellows pump.
Figure 4:
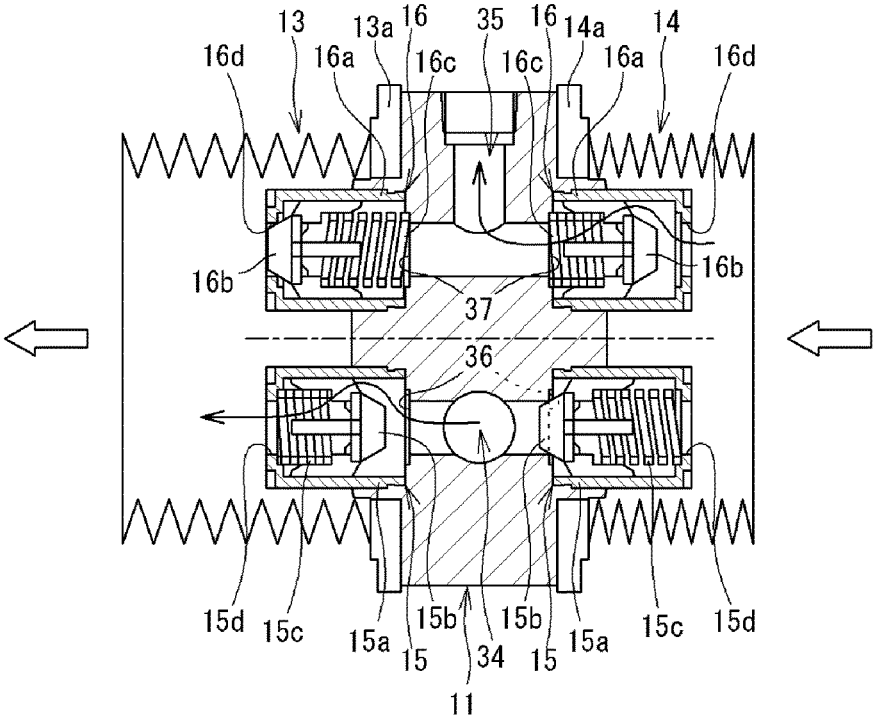
FIG. 4 is an explanatory diagram showing operation of the bellows pump.

Next, operation of the bellows pump 1 of the present embodiment will be described with reference to FIGS. 3 and 4. In FIGS. 3 and 4, the configurations of the first and second bellows 13 and 14 are shown in a simplified manner.

As shown in FIG. 3, when the first bellows 13 contracts and the second bellows 14 expands, the respective valve bodies 15*b* and 16*b* of the suction check valve 15 and the discharge check valve 16 that are mounted at the left side of the pump head 11 in the drawing receive pressure from the fluid within the first bellows 13 and move to the right sides of the respective valve cases 15*a* and 16*a* in the drawing. Accordingly, the suction check valve 15 closes, and the discharge check valve 16 opens, so that the fluid within the first bellows 13 is discharged through the discharge passage 35 to the outside of the pump.

Meanwhile, the respective valve bodies 15*b* and 16*b* of the suction check valve 15 and the discharge check valve 16 that are mounted at the right side of the pump head 11 in the drawing move to the right sides of the respective valve cases 15*a* and 16*a* in the drawing due to a suction effect by the second bellows 14. Accordingly, the suction check valve 15 opens, and the discharge check valve 16 closes, so that the fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted at the right side of the pump head 11 in the drawing receive pressure from the fluid within the second bellows 14 and move to the left sides of the respective valve cases 15*a* and 16*a* in the drawing. Accordingly, the suction check valve 15 closes, and the discharge check valve 16 opens, so that the fluid within the second bellows 14 is discharged through the discharge passage 35 to the outside of the pump.

Meanwhile, the respective valve bodies 15*b* and 16*b* of the suction check valve 15 and the discharge check valve 16 that are mounted at the left side of the pump head 11 in the drawing move to the left sides of the respective valve cases 15*a* and 16*a* in the drawing due to a suction effect by the first bellows 13. Accordingly, the suction check valve 15 opens, and the discharge check valve 16 closes, so that the fluid is sucked from the suction passage 34 into the first bellows 13.

By repeatedly performing the above operation, the left and right bellows 13 and 14 can alternately suck and discharge the fluid.

[Configurations of Switching Valves]

In FIG. 1, the first switching valve 4 switches between supply of the pressurized air from the air supply device 2 to the discharge-side air chamber 21 and the suction-side air chamber 26 of the first air cylinder portion 27 and discharge of the pressurized air from the discharge-side air chamber 21 and the suction-side air chamber 26 of the first air cylinder portion 27, and is composed of a three-position solenoid switching valve including a pair of solenoids 4*a* and 4*b*. Each of the solenoids 4*a* and 4*b* is magnetized upon reception of a command signal from the control unit 6.

When both of the solenoids 4*a* and 4*b* are in a demagnetized state, the first switching valve 4 is maintained at a neutral position, supply of the pressurized air from the air supply device 2 to the discharge-side air chamber 21 (suction/exhaust port 22) and the suction-side air chamber 26 (suction/exhaust port 25*a*) of the first air cylinder portion 27 is blocked, and both the discharge-side air chamber 21 and the suction-side air chamber 26 of the first air cylinder portion 27 communicate with and are open to the atmosphere.

In addition, when the solenoid 4*a* is magnetized, the first switching valve 4 switches to a lower position in the drawing, and the pressurized air is supplied from the air supply device 2 to the discharge-side air chamber 21 of the first air cylinder portion 27. At this time, the suction-side air chamber 26 of the first air cylinder portion 27 communicates with and is open to the atmosphere. Accordingly, the first bellows 13 can be caused to contract.

Furthermore, when the solenoid 4*b* is magnetized, the first switching valve 4 switches to an upper position in the drawing, and the pressurized air is supplied from the air supply device 2 to the suction-side air chamber 26 of the first air cylinder portion 27. At this time, the discharge-side air chamber 21 of the first air cylinder portion 27 communicates with and is open to the atmosphere. Accordingly, the first bellows 13 can be caused to expand.

The second switching valve 5 switches between supply of the pressurized air from the air supply device 2 to the discharge-side air chamber 21 and the suction-side air chamber 26 of the second air cylinder portion 28 and discharge of the pressurized air from the discharge-side air chamber 21 and the suction-side air chamber 26 of the second air cylinder portion 28, and is composed of a three-position solenoid switching valve including a pair of solenoids 5*a* and 5*b*. Each of the solenoids 5*a* and 5*b* is magnetized upon reception of a command signal from the control unit 6.

When both of the solenoids 5*a* and 5*b* are in a demagnetized state, the second switching valve 5 is maintained at a neutral position, supply of the pressurized air from the air supply device 2 into the discharge-side air chamber 21 (suction/exhaust port 22) and the suction-side air chamber 26 (suction/exhaust port 25*a*) of the second air cylinder portion 28 is blocked, and both the discharge-side air chamber 21 and the suction-side air chamber 26 of the second air cylinder portion 28 communicate with and are open to the atmosphere.

In addition, when the solenoid 5*a* is magnetized, the second switching valve 5 switches to a lower position in the drawing, and the pressurized air is supplied from the air supply device 2 to the discharge-side air chamber 21 of the second air cylinder portion 28. At this time, the suction-side air chamber 26 of the second air cylinder portion 28 communicates with and is open to the atmosphere. Accordingly, the second bellows 14 can be caused to contract.

Furthermore, when the solenoid 5*b* is magnetized, the second switching valve 5 switches to an upper position in the drawing, and the pressurized air is supplied from the air supply device 2 to the suction-side air chamber 26 of the second air cylinder portion 28. At this time, the discharge-side air chamber 21 of the second air cylinder portion 28 communicates with and is open to the atmosphere. Accordingly, the second bellows 14 can be caused to expand.

Silencers 7 for eliminating exhaust noise generated when the pressurized air within the discharge-side air chambers 21 or the suction-side air chambers 26 of the respective air cylinder portions 27 and 28 is released to the atmosphere are provided at the upstream sides of the respective switching valves 4 and 5.

[Configuration of Control Unit]

The control unit 6 controls drive of each of the first air cylinder portion 27 and the second air cylinder portion 28 of the bellows pump 1 by switching the respective switching valves 4 and 5 on the basis of detection signals of the first detection device 29 and the second detection device 31 (see FIG. 2).

Figure 5:
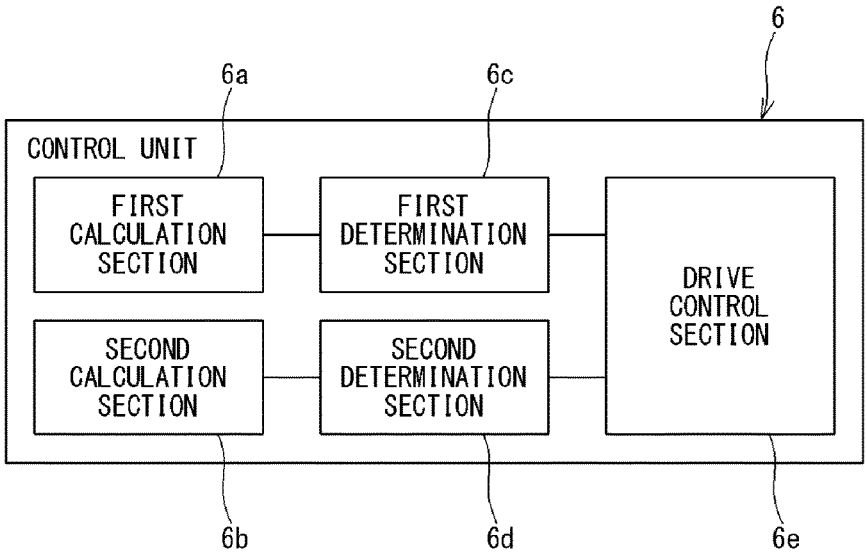
FIG. 5 is a block diagram showing the internal configuration of a control unit.

FIG. 5 is a block diagram showing the internal configuration of the control unit 6. The control unit 6 includes first and second calculation sections 6*a* and 6*b*, first and second determination sections 6*c* and 6*d*, and a drive control section 6*e*.

The first calculation section 6*a* calculates a first expansion time from the most contracted state of the first bellows 13 to the most expanded state of the first bellows 13 and a first contraction time from the most expanded state of the first bellows 13 to the most contracted state of the first bellows 13, on the basis of the respective detection signals of the pair of proximity sensors 29A and 29B. Specifically, the first calculation section 6*a* calculates, as the first expansion time, an elapsed time from a time point of end of detection by the proximity sensor 29A to a time point of detection by the proximity sensor 29B. In addition, the first calculation section 6*a* calculates, as the first contraction time, an elapsed time from a time point of end of detection by the proximity sensor 29B to a time point of detection by the proximity sensor 29A.

The second calculation section 6*b* calculates a second expansion time from the most contracted state of the second bellows 14 to the most expanded state of the second bellows 14 and a second contraction time from the most expanded state of the second bellows 14 to the most contracted state of the second bellows 14, on the basis of the respective detection signals of the pair of proximity sensors 31A and 31B. Specifically, the second calculation section 6*b* calculates, as the second expansion time, an elapsed time from a time point of end of detection by the proximity sensor 31A to a time point of detection by the proximity sensor 31B. In addition, the second calculation section 6*b* calculates, as the second contraction time, an elapsed time from a time point of end of detection by the proximity sensor 31B to a time point of detection by the proximity sensor 31A.

On the basis of the calculated first expansion time and first contraction time, the first determination section 6*c* determines a first time difference from a time point at which the first bellows 13 in the most expanded state starts contraction operation to a time point at which the second bellows 14 in the most expanded state starts contraction operation before the first bellows 13 comes into the most contracted state through the contraction operation.

The first determination section 6*c* of the present embodiment determines the first time difference, for example, by using the following equation.

First time difference=(first expansion time+first contraction time)/2

On the basis of the calculated second expansion time and second contraction time, the second determination section 6*d* determines a second time difference from a time point at which the second bellows 14 in the most expanded state starts contraction operation to a time point at which the first bellows 13 in the most expanded state starts contraction operation before the second bellows 14 comes into the most contracted state through the contraction operation.

The second determination section 6*d* of the present embodiment determines the second time difference, for example, by using the following equation.

Second time difference=(second expansion time+second contraction time)/2

On the basis of the determined first and second time differences, the drive control section 6*e* controls drive of the first and second driving devices. Specifically, the drive control section 6*e* controls drive of the first and second air cylinder portions 27 and 28 such that: contraction operation of the second bellows 14 in the most expanded state is started at a time point at which the first time difference elapses from a time point at which the first bellows 13 in the most expanded state starts contraction operation; and contraction operation of the first bellows 13 in the most expanded state is started at a time point at which the second time difference elapses from a time point at which the second bellows 14 in the most expanded state starts contraction operation.

The bellows pump device shown in FIG. 1 further includes a power switch 8, a start switch 9, and a stop switch 10.

The power switch 8 outputs an operation command for powering on/off the bellows pump 1, and the operation command is inputted to the control unit 6. The start switch 9 outputs an operation command for driving the bellows pump 1, and the operation command is inputted to the control unit 6. The stop switch 10 outputs an operation command for causing a standby state where both the first bellows 13 and the second bellows 14 are in the most contracted state.

[Control of Drive of Bellows Pump]

Figure 6:
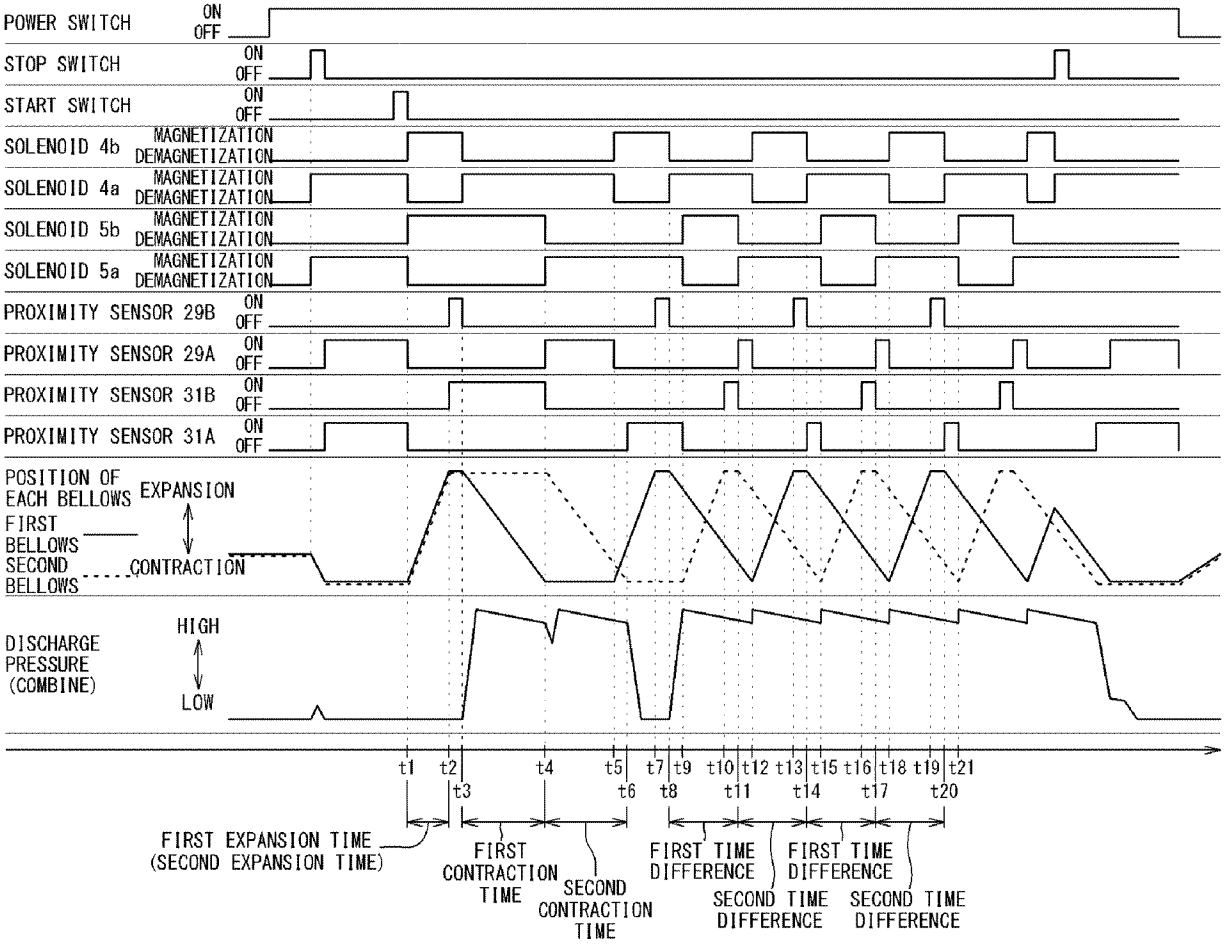
FIG. 6 is a time chart showing an example of drive control of the bellows pump.

FIG. 6 is a time chart showing an example of control of drive of the bellows pump 1 by the control unit 6. When the power switch 8 is OFF, the first and second switching valves 4 and 5 (see FIG. 1) are maintained at the neutral positions thereof. Therefore, when the power switch 8 is OFF, the air chambers 21 and 26 of the first and second air cylinder portions 27 and 28 of the bellows pump 1 communicate with the atmosphere. Thus, the first bellows 13 and the second bellows 14 are maintained at positions expanded slightly from the standby state, such that the interiors of both air chambers 21 and 26 are balanced with the atmospheric pressure.

In starting drive of the bellows pump 1, the power switch 8 is turned on by an operator, and then the stop switch 10 is turned by the operator to move the first bellows 13 and the second bellows 14 until the standby state. Specifically, the drive control section 6*e* magnetizes the solenoid 4*a* of the first switching valve 4 and the solenoid 5*a* of the second switching valve 5 to cause the first bellows 13 and the second bellows 14 to simultaneously contract until the most contracted state. Accordingly, the first bellows 13 and the second bellows 14 are maintained in the standby state. In the standby state, the proximity sensors 29A and 31A are in ON states of detecting the detection plates 30 and 32, respectively.

Next, when the start switch 9 is turned on by the operator, the drive control section 6*e* initially executes control for calculating the first expansion time and the first contraction time of the first bellows 13 and the second expansion time and the second contraction time of the second bellows 14.

Specifically, the drive control section 6*e* demagnetizes the solenoid 4*a* of the first switching valve 4 and also magnetizes the solenoid 4*b* to cause the first bellows 13 to expand from the most contracted state (standby state) to the most expanded state. At the same time with this, the drive control section 6*e* demagnetizes the solenoid 5*a* of the second switching valve 5 and also magnetizes the solenoid 5*b* to also cause the second bellows 14 to expand from the most contracted state (standby state) to the most expanded state.

When the first bellows 13 expands from the most contracted state to the most expanded state, the first calculation section 6*a* determines a time period from a time point (t1) at which the proximity sensor 29A becomes OFF to a time point (t2) at which the proximity sensor 29B becomes ON, to calculate the first expansion time (t2−t1) of the first bellows 13.

Similarly, when the second bellows 14 expands from the most contracted state to the most expanded state, the second calculation section 6*b* determines a time period from a time point (t1) at which the proximity sensor 31A becomes OFF to a time point (t2) at which the proximity sensor 31B becomes ON, to calculate the second expansion time (t2−t1) of the second bellows 14.

Next, after a predetermined time (t3−t2) elapses, the drive control section 6*e* demagnetizes the solenoid 4*b* of the first switching valve 4 and also magnetizes the solenoid 4*a* to cause only the first bellows 13 to contract from the most expanded state to the most contracted state.

At this time, the first calculation section 6*a* determines a time period from a time point (t3) at which the proximity sensor 29B becomes OFF to a time point (t4) at which the proximity sensor 29A becomes ON, to calculate the first contraction time (t4−t3) of the first bellows 13.

Then, at the first determination section 6*c*, the first time difference is determined on the bases of the calculated first expansion time and first contraction time. In the present embodiment, the first determination section 6*c* calculates the first time difference by using the following equation.

First time difference=(first expansion time+first contraction time)/2=$((t2-t1)+(t4-t3))/2$ Next, at the same time as a time point (t4) at which the first bellows 13 contracts to the most contracted state, the drive control section 6*e* demagnetizes the solenoid 5*b* of the second switching valve 5 and also magnetizes the solenoid 5*a* to cause the second bellows 14 to contract from the most expanded state to the most contracted state.

At this time, the second calculation section 6*b* determines a time period from a time point (t4) at which the proximity sensor 31B becomes OFF to a time point (t6) at which the proximity sensor 31A becomes ON, to calculate the second contraction time (t6−t4) of the second bellows 14.

Then, at the second determination section 6*d*, the second time difference is determined on the basis of the calculated second expansion time and second contraction time. In the present embodiment, the second determination section 6*d* calculates the second time difference by using the following equation.

$$\text{Second time difference}=(\text{second expansion time}+\text{second contraction time})/2=((t2-t1)+(t6-t4))/2$$

Thereafter, each time the first bellows 13 performs a one-round-trip operation, the first expansion time and the first contraction time are calculated by the first calculation section 6*a*, and the first time difference is determined on the basis of the calculated first expansion time and the first contraction time by the first determination section 6*c*, as described above.

Similarly, each time the second bellows 14 performs a one-round-trip operation, the second expansion time and the second contraction time are calculated by the second calculation section 6*b*, and the second time difference is determined on the basis of the calculated second expansion time and second contraction time by the second determination section 6*d*, as described above.

Meanwhile, the drive control section 6*e* starts drive of the first bellows 13 before the second bellows 14 comes into the most contracted state. Specifically, at a time point (t5) before the second bellows 14 comes into the most contracted state, the drive control section 6*e* demagnetizes the solenoid 4*a* of the first switching valve 4 and also magnetizes the solenoid 4*b*. Accordingly, the first bellows 13 starts expansion operation from the most contracted state.

After a predetermined time (t6–t5) from the time point at which the first bellows 13 starts expansion operation, the second bellows 14 comes into the most contracted state, and the proximity sensor 31A is switched from OFF to ON, but the drive control section 6*e* continues to maintain the second bellows 14 in the most contracted state for a while.

Thereafter, when the proximity sensor 29B is switched from OFF to ON at a time point (t7) at which the first bellows 13 comes into the most expanded state, the drive control section 6*e* demagnetizes the solenoid 4*b* of the first switching valve 4 and also magnetizes the solenoid 4*a* after a predetermined time (t8–t7) elapses. Accordingly, the first bellows 13 starts contraction operation from the most expanded state.

In addition, from a time point (t8) at which the solenoid 4*a* is magnetized, the drive control section 6*e* start counting the first time difference determined above.

Then, when a predetermined time (t9–t8) elapses from the time point at which the first bellows 13 starts contraction operation, the drive control section 6*e* demagnetizes the solenoid 5*a* of the second switching valve 5 and also magnetizes the solenoid 5*b*. Accordingly, while the first bellows 13 performs contraction operation, the second bellows 14 expands from the most contracted state to the most expanded state.

At this time, at a time point (t10) at which the second bellows 14 comes into the most expanded state, the proximity sensor 31B is switched from OFF to ON, but the drive control section 6*e* continues to maintain the second bellows 14 in the most expanded state.

Figure 8:
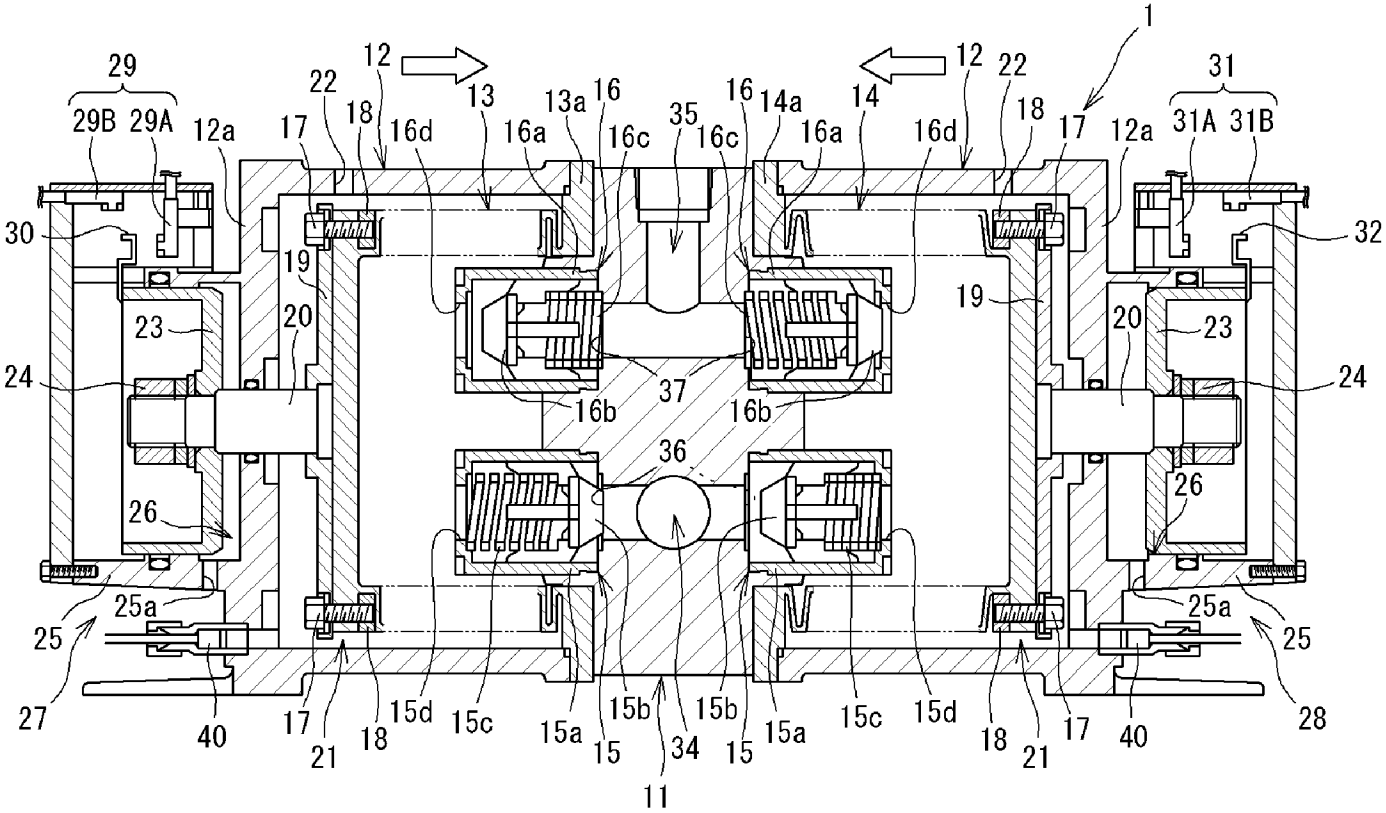
FIG. 8 is a cross-sectional view showing a state where the first bellows in a most expanded state has started contracting before the second bellows comes into a most contracted state.

Next, when the first time difference (t11–t8) elapses, the drive control section 6*e* demagnetizes the solenoid 5*b* of the second switching valve 5 and also magnetizes the solenoid 5*a*. Accordingly, before the first bellows 13 comes into the most contracted state, the second bellows 14 starts contraction operation from the most expanded state (see FIG. 8).

In addition, at a time point (t11) at which the solenoid 5*a* is magnetized, the drive control section 6*e* starts counting the second time difference determined above.

After the second bellows 14 starts contraction operation, when the proximity sensor 29A is switched from OFF to ON at a time point (t12) at which the first bellows 13 comes into the most contracted state, the drive control section 6*e* demagnetizes the solenoid 4*a* of the first switching valve 4 and also magnetizes the solenoid 4*b*. Accordingly, while the second bellows 14 performs contraction operation, the first bellows 13 expands from the most contracted state to the most expanded state.

At this time, at a time point (t13) at which the first bellows 13 comes into the most expanded state, the proximity sensor 29B is switched from OFF to ON, but the drive control section 6*e* continues to maintain the first bellows 13 in the most expanded state.

Figure 7:
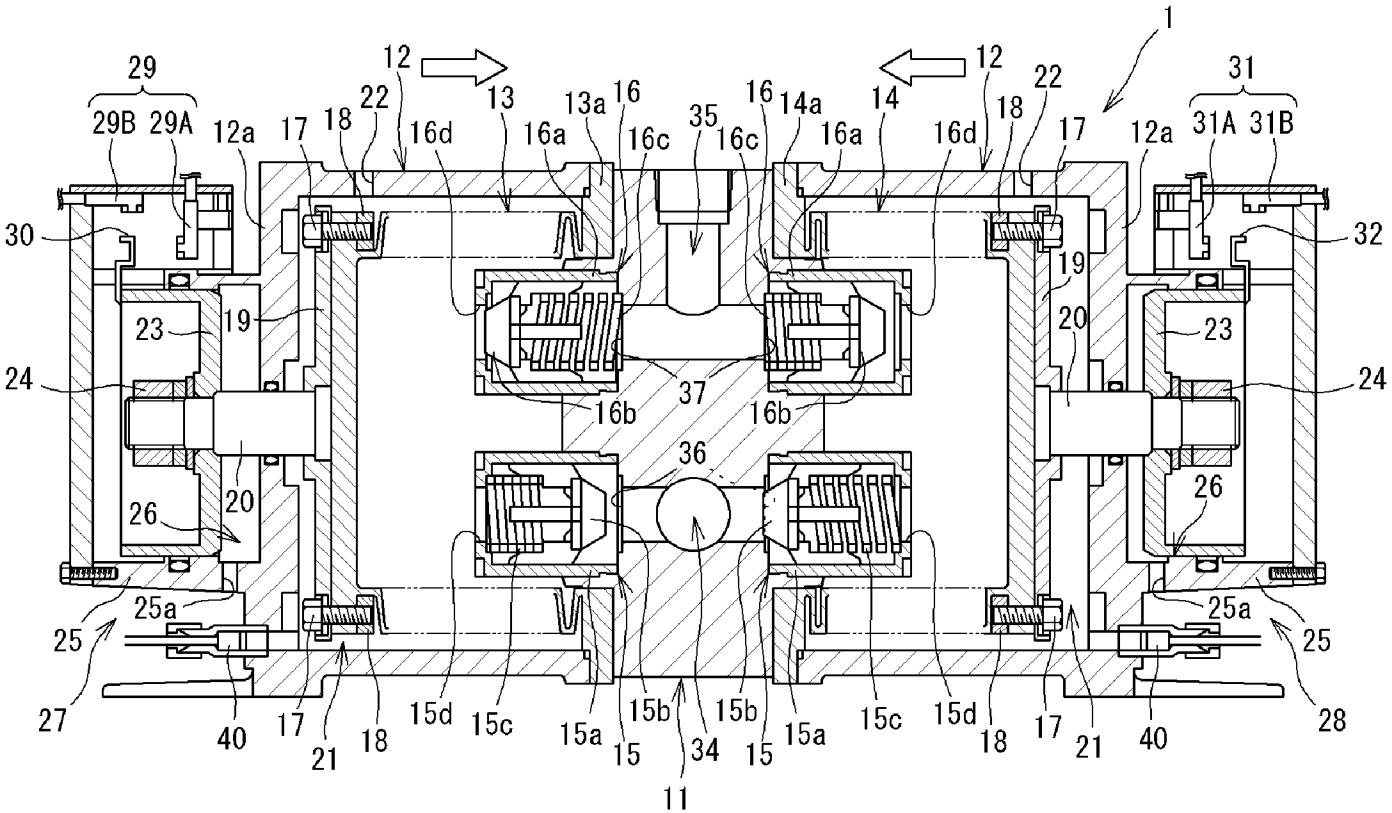
FIG. 7 is a cross-sectional view showing a state where a second bellows in a most expanded state has started contracting before a first bellows comes into a most contracted state.

Next, when the second time difference (t14–t11) elapses, the drive control section 6*e* demagnetizes the solenoid 4*b* of the first switching valve 4 and also magnetizes the solenoid 4*a*. Accordingly, before the second bellows 14 comes into the most contracted state, the first bellows 13 starts contraction operation from the most expanded state (see FIG. 7).

In addition, from a time point (t14) at which the solenoid 4*a* is magnetized, the drive control section 6*e* starts counting the first time difference determined immediately before. The first time difference determined immediately before is a time difference determined on the basis of the first expansion time (t7–t5) and the first contraction time (t12–t8) calculated as a result of an immediately-previous one-round-trip operation of the first bellows 13.

After the first bellows 13 starts contraction operation, when the proximity sensor 31A is switched from OFF to ON at a time point (T15) at which the second bellows 14 comes into the most contracted state, the drive control section 6*e* demagnetizes the solenoid 5*a* of the second switching valve 5 and also magnetizes the solenoid 5*b*. Accordingly, while the first bellows 13 performs contraction operation, the second bellows 14 expands from the most contracted state to the most expanded state.

At this time, at a time point (t16) at which the second bellows 14 comes into the most expanded state, the proximity sensor 31B is switched from OFF to ON, but the drive control section 6*e* continues to maintain the second bellows 14 in the most expanded state.

Next, when the above first time difference (t17–t14) determined immediately before elapses, the drive control section 6*e* demagnetizes the solenoid 5*b* of the second switching valve 5 and also magnetizes the solenoid 5*a*. Accordingly, before the first bellows 13 comes into the most contracted state, the second bellows 14 starts contraction operation from the most expanded state.

In addition, from a time point (t17) at which the solenoid 5*a* is magnetized, the drive control section 6*e* starts counting the second time difference determined immediately before. The second time difference determined immediately before is a time difference determined on the basis of the second expansion time (t10–t9) and the second contraction time (t15–t11) calculated as a result of an immediately-previous one-round-trip operation of the second bellows 14.

After the second bellows 14 starts contraction operation, when the proximity sensor 29A is switched from OFF to ON at a time point (t18) at which the first bellows 13 comes into the most contracted state, the drive control section 6*e* demagnetizes the solenoid 4*a* of the first switching valve 4 and also magnetizes the solenoid 4*b*. Accordingly, while the second bellows 14 performs contraction operation, the first bellows 13 expands from the most contracted state to the most expanded state.

At this time, at a time point (t19) at which the first bellows 13 comes into the most expanded state, the proximity sensor 29B is switched from OFF to ON, but the drive control section 6*e* continues to maintain the first bellows 13 in the most expanded state.

Next, when the above second time difference (t20–t17) determined immediately before elapses, the drive control section 6*e* demagnetizes the solenoid 4*b* of the first switching valve 4 and also magnetizes the solenoid 4*a*. Accordingly, before the second bellows 14 comes into the most contracted state, the first bellows 13 starts contraction operation from the most expanded state.

Thereafter, the drive control section 6*e* controls drive of the bellows pump 1 such that, as described above, on the basis of the first and second time differences determined immediately before, the first bellows 13 is caused to contract from the most expanded state before the second bellows 14 comes into the most contracted state, and the second bellows 14 is caused to contract from the most expanded state before the first bellows 13 comes into the most contracted state.

Therefore, even when the first and second contraction time (discharge times) and the first and second expansion times (suction times) vary due to a discharge load of the fluid or the like, drive of the bellows pump 1 can be controlled at an optimum time so as to follow the variation. As a result, as shown in the lowermost part of FIG. 6, the discharge pressure of the bellows pump 1 transitions within a certain pressure range without rapidly decreasing, while the drive control section 6*e* controls drive of the bellows pump 1 on the basis of the first and second time differences. Thus, pulsation of the pump 1 can be suppressed.

In the present embodiment, although the first and second time differences determined immediately before are used, drive of the bellows pump 1 may be controlled by using the first and second time differences initially determined immediately after start of operation, when there is no variation in the above discharge times and suction times. In this case, switching between the expansion operation and the contraction operation of the first and second bellows 13 and 14 may be performed every predetermined time by using a timer or the like, not by using the proximity sensors 29A, 29B, 31A, and 31B.

In stopping drive of the bellows pump 1, first, the stop switch 10 is turned on by the operator. The drive control section 6*e* that has received this operation signal moves the first bellows 13 and the second bellows 14 into the standby state. At this time, when either one of the first bellows 13 and the second bellows 14 is performing expansion operation, the drive control section 6*e* stops the expansion operation and immediately causes the either one of the first bellows 13 and the second bellows 14 to start contraction operation. Then, when the first bellows 13 and the second bellows 14 come into the standby state, the power switch 8 is turned off by the operator.

FIG. 9 is a table showing results of a verification test for bellows pumps. The verification test was conducted for the present invention product and conventional three types of bellows pumps having a maximum discharge amount of 40 liters. As the conventional three types of bellows pumps, a tie rod connection type in which a pair of bellows are integrally connected to each other by a tie rod, an accumulator-externally-mounted type in which an accumulator is mounted at the discharge side of a bellows pump, and an accumulator-built-in type in which an accumulator is built-in are used. In addition, as test conditions, the pressure of the pressurized air was set to 0.4 MPa and the discharge pressure was set to 0.33 MPa, and comparison was made. Each of the numerical values in the parentheses in the table indicates a ratio relative to a numerical value of the present invention product.

As shown in FIG. 9, the flow rate of the present invention product has increased from the flow rates of the conventional three types, so that the amount of the discharged fluid of the present invention product is found not to have decreased from those of the conventional bellows pumps.

The pulse pressure range (the difference between the maximum discharge pressure and the minimum discharge pressure) of the present invention product is larger than the pulse pressure range of the conventional accumulator-built-in type, but has decreased as compared to the pulse pressure ranges of the conventional tie rod connection type and accumulator-externally-mounted type, so that pulsation of the pump of the present invention product is found to have been able to be reduced.

The footprint (the occupation area in plan view) of the present invention product has increased slightly as compared to the footprints of the conventional tie rod connection type and accumulator-built-in type, but has reduced as compared to the footprint of the conventional accumulator-externally-mounted type, so that the installation space for the present invention product is found to have been able to be inhibited from being significantly increased.

As described above, according to the bellows pump device of the present embodiment, the first bellows 13 and the second bellows 14 are made expandable/contractible independently of each other, and the control unit 6 is configured to perform drive control such that the second bellows 14 is caused to contract from the most expanded state before the first bellows 13 comes into the most contracted state, and the first bellows 13 is caused to contract from the most expanded state before the second bellows 14 comes into the most contracted state. Thus, the following advantageous effects are achieved. Specifically, at time of switching from contraction of one bellows (discharge) to expansion thereof (suction), the other bellows has already contracted to discharge the fluid. Thus, fall of the discharge pressure at the time of switching can be reduced. As a result, pulsation at the discharge side of the bellows pump 1 can be reduced.

In addition, the bellows pump device of the present embodiment does not need to ensure a space for installing another member (accumulator) other than the bellows pump as in the case where an accumulator is mounted at the discharge side of a conventional bellows pump. Thus, a substantial increase in an installation space can be suppressed. Furthermore, since the bellows pump device of the present embodiment discharges the fluid by using a pair of the bellows 13 and 14 similarly to a conventional bellows pump having a pair of bellows connected to each other by a tie rod, the amount of the discharged fluid does not decrease.

The control unit 6 is able to perform drive control so as to use the first time difference determined on the basis of the first expansion time and the first contraction time of the first bellows 13, to cause the second bellows 14 in the most expanded state to contract before the first bellows 13 comes into the most contracted state, and also so as to use the second time difference determined on the basis of the second expansion time and the second contraction time of the second bellows 14, to cause the first bellows 13 in the most expanded state to contract before the second bellows 14 comes into the most contracted state. Accordingly, the second bellows can be assuredly caused to contract before the first bellows comes into the most contracted state, and also the first bellows can be assuredly caused to contract before the second bellows comes into the most contracted state.

Immediately after start of operation of the bellows pump 1, the control unit 6 calculates the expansion times and the contraction times of the first and second bellows 13 and 14 beforehand, and performs drive control. Thus, even when these expansion times and these contraction times are not known before start of operation, the second bellows 14 (first bellows 13) can be assuredly caused to contract before the first bellows 13 (second bellows 14) comes into the most contracted state.

The control unit 6 performs drive control on the basis of the first and second time differences determined immediately before. Thus, even when the first expansion time and the first contraction time of the first bellows 13 (the second expansion time and the second contraction time of the second bellows 14) vary, the second bellows 14 (first bellows 13) can be assuredly caused to contract so as to follow the variation, before the first bellows 13 (second bellows 14) comes into the most contracted state.

The present invention is not limited to the above embodiments, and changes may be made as appropriate within the scope of the present invention described in the claims. For example, the first and second detection devices 29 and 31 in the above embodiment are composed of proximity sensors, but may be composed of other detection device such as limit switches or the like. In addition, the first and second detection devices 29 and 31 detect the most expanded states and the most contracted states of the first and second bellows 13 and 14, but may detect other expanded/contracted states thereof. Furthermore, the first and second driving devices 27 and 28 in the present embodiment are driven by the pressurized air, but may be driven by another fluid, a motor, or the like.

REFERENCE SIGNS LIST

6 control unit
6*a* first calculation section
6*b* second calculation section
6*c* first determination section
6*d* second determination section
6*e* drive control section
11 pump head
13 first bellows
14 second bellows
15, 16 check valve
27 first air cylinder portion (first driving device)
28 second air cylinder portion (second driving device)
29 first detection device
31 second detection device
34 suction passage
35 discharge passage

The invention claimed is:

1. A bellows pump device comprising:

a pump head in which a suction passage and a discharge passage for a fluid are formed;

a suction check valve configured to permit flow of the fluid in one direction in the suction passage and block flow of the fluid in another direction in the suction passage;

a discharge check valve configured to permit flow of the fluid in one direction in the discharge passage and block flow of the fluid in another direction in the discharge passage;

first and second bellows mounted on the pump head so as to be expandable/contractible independently of each other and configured to suck the fluid from the suction passage thereinto by expansion thereof and discharge the fluid therefrom to the discharge passage by contraction thereof;

a first driving device configured to cause the first bellows to perform expansion/contraction operation continuously between a most expanded state and a most contracted state;

a second driving device configured to cause the second bellows to perform expansion/contraction operation continuously between a most expanded state and a most contracted state;

a first detection device configured to detect an expanded/contracted state of the first bellows;

a second detection device configured to detect an expanded/contracted state of the second bellows; and a control unit programmed to control drive of the first and second driving devices on the basis of each of detection signals of the first and second detection devices such that the second bellows is caused to contract from the most expanded state before the first bellows comes into the most contracted state, and the first bellows is caused to contract from the most expanded state before the second bellows comes into the most contracted state, wherein the control unit includes:

a first calculation section configured to calculate a first expansion time from the most contracted state of the first bellows to the most expanded state of the first bellows and a first contraction time from the most expanded state of the first bellows to the most contracted state of the first bellows on the basis of the detection signal of the first detection device;

a second calculation section configured to calculate a second expansion time from the most contracted state of the second bellows to the most expanded state of the second bellows and a second contraction time from the most expanded state of the second bellows to the most contracted state of the second bellows on the basis of the detection signal of the second detection device;

a first determination section configured to determine, on the basis of the calculated first expansion time and the first contraction time, a first time difference from a time point at which the first bellows in the most expanded state starts contraction operation to a time point at which the second bellows in the most expanded state starts contraction operation before the first bellows comes into the most contracted state through the contraction operation;

a second determination section configured to determine, on the basis of the calculated second expansion time and second contraction time, a second time difference from a time point at which the second bellows in the most expanded state starts contraction operation to a time point at which the first bellows in the most expanded state starts contraction operation before the second bellows comes into the most contracted state through the contraction operation; and a drive control section configured to control drive of the first and second driving devices such that contraction operation of the second bellows in the most expanded state is started at a time point at which the first time difference elapses from a time point at which the first bellows in the most expanded state starts contraction operation, and contraction operation of the first bellows in the most expanded state is started at a time point at which the second time difference elapses from a time point at which the second bellows in the most expanded state starts contraction operation.

2. The bellows pump device according to claim 1, wherein the first determination section determines the first time difference on the basis of the first expansion time and first contraction time calculated immediately before, the second determination section determines the second time difference on the basis of the second expansion time and second contraction time calculated immediately before, and the drive control section controls drive of the first and second driving devices on the basis of the first and second time differences determined immediately before.

3. The bellows pump device according to claim 1, wherein the first determination section calculates the first time difference using the following equation:

first time difference=(first expansion time+first contraction time)/2; and the second determination section calculates the second time difference using the following equation:

the second time difference=(second expansion time+second contraction time)/2.

* * * * *